US012624912B1

(12) United States Patent
Stern et al.

(10) Patent No.: US 12,624,912 B1
(45) Date of Patent: May 12, 2026

(54) SLIDE ASSEMBLY FOR A FIREARM, AS WELL AS AN INDICATOR FOR USE IN THE SLIDE ASSEMBLY, AND A FIREARM COMPRISING THE SLIDE ASSEMBLY, AND A METHOD FOR ASSEMBLING THE SLIDE ASSEMBLY

(71) Applicant: Glock Technology GmbH, Ferlach (AT)

(72) Inventors: Thomas Stern, Neubau (AT); Clemens Gurtner, Vienna (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 19/045,365

(22) Filed: Feb. 4, 2025

(51) Int. Cl.
*F41A 9/53* (2006.01)
*F41A 3/66* (2006.01)

(52) U.S. Cl.
CPC . *F41A 9/53* (2013.01); *F41A 3/66* (2013.01)

(58) Field of Classification Search
CPC .. F41A 9/53; F41A 17/06; F41A 19/01; F41A 9/62; F41A 3/66; F41G 1/065; F41G 1/30; F41G 11/005
USPC ... 42/1.05, 1.01, 1.03, 1.02, 1.04, 70.01, 46, 42/25
See application file for complete search history.

(56) References Cited

U.S. PATENT DOCUMENTS 891,438 A * 6/1908 Peard ..... F41A 9/53 42/1.05
1,028,032 A * 5/1912 Krag ..... F41A 9/53 89/142
1,082,969 A * 12/1913 Nelson ..... F41A 17/64 89/196
1,896,820 A * 2/1933 Jolidon ..... F41A 17/38 42/25
3,997,994 A * 12/1976 Kastner ..... F41A 19/13 42/9
4,100,691 A * 7/1978 Wicklund ..... F41A 9/53 42/1.05
4,726,136 A * 2/1988 Dornaus ..... F41A 17/64 42/70.08
5,896,691 A * 4/1999 Kaminski ..... F41G 1/35 42/117
6,257,116 B1 * 7/2001 Moczijdlower ..... F41A 21/488 89/184

(Continued)

FOREIGN PATENT DOCUMENTS

DE 370907 C 3/1923
DE 164853 C 5/1948
EP 1586846 A2 10/2005

*Primary Examiner* — Michael D David
(74) *Attorney, Agent, or Firm* — Fishman Stewart PLLC

(57) ABSTRACT

The invention relates to a slide assembly (2) for a firearm (1), the slide assembly (2) comprising:
a slide (5);
a barrel (7) with a cartridge chamber (21);
an indicator (23) for indicating whether a cartridge (22) may be loaded in the cartridge chamber (21), wherein the indicator (23) has a first lever arm (24) and a second lever arm (25), wherein a pivot bearing (26) for pivotably receiving the indicator (23) in the slide (5) is formed between the first lever arm (24) and the second lever arm (25).
The pivot bearing (26) has a first pin (34) on a first side (33) and has a second pin (36) on a second side (35) with respect to a transverse direction (13). The first pin (34) is received in the slide (5) in a first pin receptacle (38) and the second pin (36) is received in the slide (5) in a second pin receptacle (39).

15 Claims, 10 Drawing Sheets

(56) References Cited

U.S. PATENT DOCUMENTS

| | | | | |
|---|---|---|---|---|
| 6,857,213 | B2 * | 2/2005 | Fluhr | F41A 9/53 42/1.05 |
| 7,305,786 | B2 | 12/2007 | McGarry | |
| 8,109,023 | B2 | 2/2012 | Pikielny | |
| 8,245,426 | B2 | 8/2012 | Pikielny | |
| 8,904,690 | B1 * | 12/2014 | Cantrell | F41A 19/06 42/6 |
| 9,222,745 | B2 * | 12/2015 | Kallio | F41A 17/72 |
| 10,900,732 | B2 * | 1/2021 | Galie | F41A 19/69 |
| 11,300,378 | B2 * | 4/2022 | Galie | F41A 19/10 |
| 11,519,692 | B2 | 12/2022 | Thomele | |
| 11,530,894 | B2 * | 12/2022 | Dechant | F41A 21/488 |
| 11,761,732 | B2 * | 9/2023 | Thomele | F41G 11/005 42/1.02 |
| 12,385,708 | B2 * | 8/2025 | French | F41A 19/10 |
| 12,435,939 | B1 * | 10/2025 | Sugg | F41A 21/325 |
| 2008/0039962 | A1 * | 2/2008 | McRae | G01S 17/88 356/3 |
| 2015/0219425 | A1 * | 8/2015 | Beckman | F41H 5/12 89/1.11 |
| 2021/0003362 | A1 * | 1/2021 | Dechant | F41A 33/00 |

* cited by examiner

SLIDE ASSEMBLY FOR A FIREARM, AS WELL AS AN INDICATOR FOR USE IN THE SLIDE ASSEMBLY, AND A FIREARM COMPRISING THE SLIDE ASSEMBLY, AND A METHOD FOR ASSEMBLING THE SLIDE ASSEMBLY

TECHNICAL FIELD

The invention relates to a slide assembly for a firearm, as well as an indicator for use in the slide assembly, and a firearm comprising the slide assembly, and a method for assembling the slide assembly.

BACKGROUND

DE 164853 C discloses an indicator for a firearm for indicating whether a cartridge may be loaded in a cartridge chamber. The indicator is a rocker arm that is pivotably mounted in the slide by means of a pin.

The firearm known from DE 164853 C has the disadvantage that it is only with difficulty that the indicator can be fitted in the slide.

Other similar indicators are known from EP 1586846 B1, DE 370907 C, U.S. Ser. No. 11/519,692 B2, U.S. Pat. No. 8,109,023 B2, U.S. Pat. No. 8,245,426 B2, U.S. Pat. No. 891,438 A and also from certain versions of the Springfield model XD pistol.

These so called chamber status indicators or loaded chamber indicators are used in some firearms in order to comply with the laws of certain U.S. states. Nevertheless, a user should not rely solely on a loaded chamber indicator to determine the loaded status of a firearm equipped with such an indicator. Safe firearm handling practices and the instructions and safety warnings provided by the firearm's manufacturer must always be followed to minimize the risk of a negligent discharge, serious injury or death.

OVERVIEW

The object of the present invention was to overcome the disadvantages of the prior art and to provide a slide assembly, as well as a firearm equipped with the slide assembly, which improves the reception of the indicator.

This object is achieved by a device and a method according to the claims.

According to the invention, a slide assembly for a firearm is formed. The slide assembly comprises:

a slide;

a barrel with a cartridge chamber;

an indicator for indicating whether a cartridge may be loaded in the cartridge chamber, wherein the indicator has a first lever arm and a second lever arm, wherein the first lever arm extends in a longitudinal direction into the cartridge chamber, wherein the first lever arm has a cartridge butting area for butting against a cartridge that may be received in the cartridge chamber and wherein the second lever arm is turned away from the cartridge chamber, wherein a pivot bearing for pivotably receiving the indicator in the slide is formed between the first lever arm and the second lever arm, wherein a barrel receptacle for receiving the barrel is formed in the slide and wherein an indicator receptacle for receiving the indicator is formed in the slide.

The pivot bearing has a first pin on a first side and a second pin on a second side with respect to a transverse direction. The indicator receptacle has a first pin receptacle and a second pin receptacle, wherein the first pin is received in the slide in the first pin receptacle and the second pin is received in the slide in the second pin receptacle.

The slide assembly according to the invention has the advantage that a stable reception of the indicator in the slide can be achieved by the pivot bearing according to the invention. In addition, by means of the measures according to the invention it can be achieved that the indicator can be easily inserted into the slide and can be easily removed again from the slide. In particular, by means of the measures according to the invention it can be achieved that the indicator can be inserted into the slide and easily removed again from the slide without the use of a tool. Overall, the user-friendliness can be increased by the measures according to the invention.

The pins arranged on the indicator can also be of a robust design, so that the lifetime of the indicator can be increased. In addition, the indicator according to the invention allows the number of individual parts to be reduced. Furthermore, the indicator according to the invention can be easily manufactured.

In particular, it may be provided that the indicator is designed as a rocker arm.

It may also be provided that the indicator should remain in a rest position when no cartridge is loaded in the cartridge chamber and that the indicator should remain in an indicating position when a cartridge is loaded in the cartridge chamber.

In particular, it may be provided that the indicator can be tilted between the rest position and the indicating position.

It may also be provided that the indicator should move into the indicating position by a cartridge that is loaded into the cartridge chamber. The cartridge in the cartridge chamber should press against the cartridge butting area so as to move the indicator into the indicating position.

It may also be provided that in the indicating position an indicating area of the indicator should protrude from a slide surface of the slide.

It may also be provided that an indicating coding is formed on the indicating area. The indicating coding may be for example a colour marking or a colour dot, preferably provided in a depression to potentially reduce abrasion. The colour marking or the colour dot may be multilayered or multi-coloured if necessary. The indicating coding may also take the form of a word, such as for instance "Loaded". Furthermore, it is also conceivable that the indicating coding comprises a material that may light up in the dark. Such a material may be tritium, for example. Such a material may also be some other fluorescent material. Such a material may also be some other phosphorescent material. In particular, it may be provided that the indicating area is formed on an independent component which is inserted in the indicator.

Furthermore, it may be expedient that the first pin and the second pin of the pivot bearing are formed as one part with the first lever arm and the second lever arm of the indicator. This has the advantage that this measure allows increased strength of the indicator to be achieved. In addition, this measure allows the number of individual components to be reduced.

Furthermore, it may be provided that the indicator receptacle comprises an indicator slit, which is arranged between the first pin receptacle and the second pin receptacle with respect to the transverse direction and extends to an upper side of the slide, wherein the first lever arm is received in the indicator slit and is visible from the outside through the indicator slit, wherein a first butting flank is formed above the first pin receptacle and a second butting flank is formed above the second pin receptacle, wherein the first pin receptacle and the second pin receptacle are formed as a recess, which recesses laterally adjoin the indicator slit in the transverse direction and extend under the first butting flank and the second butting flank. This has the advantage that the indicator can be easily received in the indicator slit. This makes it easy to assemble the slide assembly. In particular, it may be provided that, for the assembly of the slide assembly, the two pins are pushed in under the butting flanks along the pin receptacle until the indicator is in its final position.

In addition, it may be provided that a depression is formed in the upper side of the slide behind the indicator receptacle, when seen in the longitudinal direction, in particular that the depression serves for receiving an attachment, wherein the first pin receptacle and the second pin receptacle lead into the depression, wherein the indicator can be inserted into the indicator receptacle via the depression. This has the advantage that this measure allows easy installation and easy removal of the indicator in the slide.

Various attachments for attaching to firearms are known from the prior art. In particular, sights and optics, such as for instance red dot sights and reflex sights, for mounting on a slide of a pistol are known. The sights can in this case be obtained from a wide variety of manufacturers and therefore often have different shapes or fastening geometries. In order to create the possibility of mounting different sights with different shapes on the slide, the use of adapter plates may be necessary. Different adapter plates allow the possibility of mounting different sights with different shapes on a mounting receptacle of a predetermined form on the slide.

Furthermore, it is also conceivable that the attachment is a simple cover plate, which completes the outer geometry of the slide. Such a cover plate may serve for example as a placeholder for the aforementioned attachments and be mounted on the slide when none of the aforementioned attachments are mounted on the slide.

In a further embodiment it is however also conceivable that the depression remains open and serves only for introducing the indicator. Furthermore, it is also conceivable that the attachment only has the task of closing the depression.

Also advantageous is a specific embodiment according to which it may be provided that the indicator slit extends into the depression, when seen in the longitudinal direction. This measure can make it easier to install and remove the indicator.

According to a development, it is possible that an ejection window, which serves for receiving a cartridge chamber housing with the cartridge chamber of the barrel located in the cartridge chamber housing, is formed in the slide, wherein the indicator slit extends into the ejection window, when seen in the longitudinal direction. This measure can make it easier to install and remove the indicator.

Furthermore, it may be expedient if a first front stop is formed between the first pin receptacle and the ejection window and if a second front stop is formed between the second pin receptacle and the ejection window, wherein the first front stop and the second front stop serve for positioning the first pin and the second pin in the longitudinal direction. This has the advantage that this measure can make it easier for the indicator to be inserted into the slide. In particular, this measure allows the positioning accuracy when inserting the indicator into the slide to be improved. Furthermore, by means of this measure it can be achieved that the indicator inserted into the slide is received in the slide exactly in position. Consequently, this measure could reduce the likelihood of the indicator being displaced due to the forces occurring during the operation of the firearm.

In addition, it may be provided that a first rear stop is formed in the region of the first pin receptacle, wherein the first rear stop reaches downwards in a web-like manner from the first butting flank, and that a second rear stop is formed in the region of the second pin receptacle, wherein the second rear stop reaches downwards in a web-like manner from the second butting flank, wherein a first passage is formed below the first rear stop and wherein a second passage is formed below the second rear stop, wherein the first passage and the second passage are formed in such a way that the first pin and the second pin can be led through the first passage and the second passage in the longitudinal direction under the first rear stop and the second rear stop. This has the advantage that by means of this measure the indicator is not only restricted in its forward displaceability, but is also restricted in its rearward displaceability. The way in which the rear stop is formed according to the invention can achieve the effect that the indicator can be easily pushed into the indicator receptacle, by the two pins being pushed into the slide through the passage under the rear stop.

In particular, it may be provided that the indicator is held in its position by the first front stop and the first rear stop or by the second front stop and the second rear stop.

In addition, it may be provided that a positioning element, which is received in the indicator receptacle under the indicator, is formed, wherein a positioning spring is arranged in the positioning element, wherein the indicator is pushed upwards by means of the positioning spring. This has the advantage that the indicator can be easily secured in the indicator receptacle after insertion into the indicator receptacle. By providing a positioning element which is received in the slide or is inserted into it under the indicator, easier assembly and easier disassembly of the slide assembly can be achieved. By means of the positioning spring, not only can holding of the indicator in its position be achieved, but the indicator can also be received in the slide or held in such a way that the indicator is forced into its rest position by means of the positioning spring. Therefore, when cartridge is received in the cartridge chamber the indicator may be forced out of its rest position into its indicating position against the spring force of the positioning spring.

It may also be provided that a positioning spring counterpart is formed on the second lever arm of the indicator, wherein the positioning spring counterpart interacts with the positioning spring and serves for guiding the positioning spring. In particular, it may be provided that the positioning spring counterpart takes the form of an elevation. Particularly preferably, the positioning spring counterpart may take the form of a dome-like elevation.

It may also be provided that a positioning element depression is formed in the indicator receptacle, wherein the positioning element depression is formed in a way in which it complements the form and the function of a positioning element base of the positioning element and serves for receiving the positioning element. The advantage of this is that the positioning element can be received in the slide easily and exactly in position by means of the positioning depression.

In addition, it may be provided that the first pin has a roof-shaped upper side with a first pin area and a second pin area, wherein the first pin area and the second pin area are arranged at an angle to one another, wherein a transition radius is formed between the first pin area and the second pin area. This has the advantage that this measure allows an improved tilting movement between the indicating position and the rest position to be achieved, so that the quality of the firearm can be improved. In particular, this measure can achieve the effect that, when the indicator is tilted, a rolling movement of the indicator relative to the slide takes place and no sliding movement of the indicator relative to the slide takes place, which could reduce the extent of wear over time.

In an alternative embodiment variant, it is also conceivable that the first pin and the second pin have a concavely curved surface. In particular, it may be provided that the first pin and the second pin are elliptically formed in their cross section.

In another alternative, it may be provided that the first pin and the second pin are of a circular-cylindrical form.

In again another alternative, it may be provided that the upper side of the first pin and of the second pin is formed according to one of the variants described above and that the underside of the first pin and of the second pin is of a flat form.

It may also be provided that on the first butting flank and on the second butting flank there is respectively formed a first butting area and a second butting area, which serve for the butting of the first pin and the second pin.

In particular, it may be provided that the first butting area and the second butting area are formed as a flat surface area.

Furthermore, it may also be provided that the first pin area and the second pin area are formed as a flat surface area.

In particular, with such a specific embodiment of the adjacent surface areas, the wear when tilting the indicator may be reduced.

Also advantageous is a specific embodiment according to which it may be provided that an end face of the first lever arm has a convex curvature, when seen in a cross section. This has the advantage that this measure can achieve the effect that, when tilting the indicator, a gap between the indicator and the barrel, in particular in the region of the cartridge chamber, can be kept as small as possible both for the rest position and for the indicating position. Consequently, this measure may improve the protection of the cartridge chamber against the ingress of dirt entering from outside.

In particular, it may be provided that the first pin has a first pin height. It may also be provided that the first passage has a first passage height. It may be provided that the first passage height is greater than the first pin height. This measure can achieve the effect that the first pin can be easily displaced into its position through the first passage. In particular, it may be provided that the first passage height is between 101% and 180%, preferably between 105% and 120%, of the first pin height.

According to the invention, an indicator for fitting in a slide assembly according to one of the specific embodiments above is provided. The indicator comprises a first lever arm and a second lever arm; the first lever arm has a cartridge butting area intended for butting against a cartridge received in the cartridge chamber. A pivot bearing for pivotably receiving the indicator in the slide assembly is formed between the first lever arm and the second lever arm.

The pivot bearing has a first pin on a first side and a second pin on a second side with respect to a transverse direction.

The indicator according to the invention has the advantage that a stable reception of the indicator in the slide can be achieved by the pivot bearing according to the invention. The pins arranged on the indicator can also be of a robust design, so that the lifetime of the indicator may be increased. In addition, the indicator according to the invention allows the number of individual parts to be reduced. Furthermore, the indicator according to the invention can be easily manufactured.

According to the invention, a firearm is formed. The firearm comprises:

- a frame assembly;
- a slide assembly, wherein the slide assembly is received on the frame assembly. The slide assembly is formed according to one of the specific embodiments above.

The firearm according to the invention may preferably be a pistol. It may however also be a rifle, carbine, submachine gun, shotgun, etc. Firearms are guns that can be carried and used by one person.

Method for assembling a slide assembly of a firearm, the method comprising the method steps of:

- providing a slide;
- providing a barrel with a cartridge chamber;
- providing an indicator for indicating whether a cartridge may be loaded in the cartridge chamber, wherein the indicator has a first lever arm and a second lever arm, wherein the first lever arm has a cartridge butting area for butting against a cartridge that may be received in the cartridge chamber and wherein a pivot bearing for pivotably receiving the indicator in the slide is formed between the first lever arm and the second lever arm, wherein a barrel receptacle for receiving the barrel is formed in the slide and wherein an indicator receptacle for receiving the indicator is formed in the slide, wherein the pivot bearing has a first pin on a first side and has a second pin on a second side with respect to a transverse direction, and the indicator receptacle has a first pin receptacle and a second pin receptacle;
- inserting the indicator into the indicator receptacle so that the first lever arm extends in a longitudinal direction into the cartridge chamber and the second lever arm is turned away from the cartridge chamber and the first pin is received in the first pin receptacle in the slide and the second pin is received in the second pin receptacle in the slide.

The method according to the invention has the advantage that easier assembly and easier disassembly of the slide assembly is achieved. In particular, it may be provided by the measures according to the invention that possible errors during the assembly of the slide assembly are reduced.

In particular, when inserting the indicator into the indicator receptacle, it may be provided that the indicator is inserted into the indicator receptacle via the depression.

In this case, in a first step, the indicator can be introduced into the depression. In a second step, the indicator can be displaced forwards in the longitudinal direction in order to reach its position in the indicator receptacle.

It may in this case be provided that the two pins are inserted into the respective pin receptacle. In this case, the two pins can be respectively led through the first passage and through the second passage under the respective rear stop in order to be able to be displaced into the indicator receptacle. In a subsequent method step, the indicator can be manually moved upwards so that the two pins can rest against the two butting areas of the butting flanks. In a further method step, the positioning element can be pushed into the free space under the indicator also through the depression. The positioning spring can be compressed thereby. The shaping of the positioning element or the way in which the positioning element depression is of a complementary form and function allows the effect to be achieved that the positioning element can be held in position between the slide and the indicator.

BRIEF DESCRIPTION OF THE DRAWINGS

For better understanding of the invention, it is explained in more detail with reference to the following figures.

They respectively show in a greatly simplified, schematic representation.

DETAILED DESCRIPTION

Figure 1:
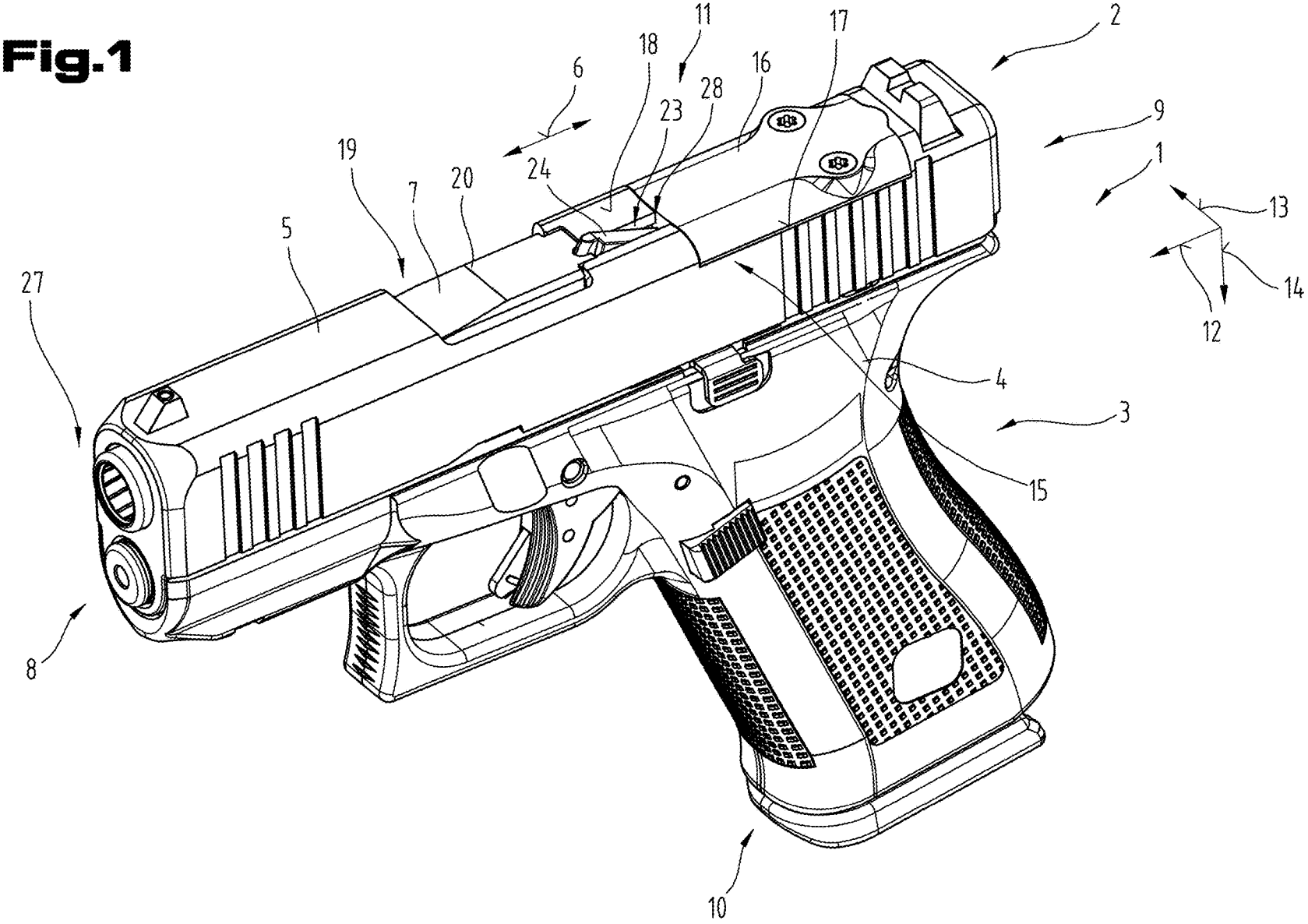
FIG. 1 a first exemplary embodiment of a firearm in the form of a pistol in a perspective representation.

As an introduction, it should be noted that in the differently described embodiments the same parts are provided with the same reference numerals or the same component designations, it being possible for the disclosures contained throughout the description to be applied analogously to the same parts with the same reference numerals or the same component designations. Also, the positional indications chosen in the description, such as for example top, bottom, side, etc., refer to the figure directly being described or shown, and these positional indications can be transferred analogously to the new position in the case of a change in position.

FIG. 1 shows a perspective view of a first exemplary embodiment of a firearm 1.

In FIGS. 1 to 7, a first embodiment of the firearm 1 is shown, with the same reference numerals or component designations as in the preceding figures being used for the same parts. In order to avoid unnecessary repetitions, reference is made to the detailed description in the preceding figures. The structure of the firearm 1 is described on the basis of joint consideration of the individual figures.

As can be seen from FIG. 1, it may be provided that the firearm 1 comprises a slide assembly 2. The slide assembly 2 may comprise a slide 5.

It may also be provided that the firearm 1 comprises a frame assembly 3. The frame assembly 3 may comprise a frame 4.

In particular, it may be provided that the slide assembly 2 is received on the frame assembly 3 displaceably in a slide displacement direction 6.

It may also be provided that a barrel 7 is received on the slide assembly 2. In particular, it may be provided that a barrel receptacle 27, in which the barrel 7 is received, is formed in the slide 5.

The positional indications chosen in the description, such as for example top, bottom, side, etc., refer to the position of the firearm 1 shown in FIG. 1. This position may also be referred to as the position of use. In this case, front or a front side 8 is on the left side of FIG. 1, and consequently on the side of the muzzle opening of the barrel 7. Rear or a rear side 9 is correspondingly on the side opposite from the muzzle opening of the barrel 7. The underside 10 is at the bottom and an upper side 11 is at the top.

A longitudinal direction 12 extends parallel to the slide displacement direction 6. A transverse extent or transverse direction 13 extends in the width of the firearm 1 transversely to the slide displacement direction 6. A vertical extent or vertical direction 14 extends from top to bottom.

In particular, it may be provided that, in the state of use of the firearm 1, the slide assembly 2 is displaceably coupled to the frame assembly 3.

As can also be seen from FIG. 1, it may be provided that a depression 15 is formed in the slide 5. In particular, it may be provided that the depression 15 is formed on the upper side 11 of the slide 5. It may also be provided that an attachment 16, which serves for inserting into the depression 15, is provided. In particular, it may be provided that the depression 15 has a depression base area 17. The depression base area 17 may be arranged at a distance from a slide surface 18. In particular, it may be provided that the attachment 16 butts against the depression base area 17.

It may also be provided that an ejection window 19 is formed in the slide 5. The ejection window 19 may interrupt the outer contour of the slide 5. In particular, it may be provided that the ejection window 19 leads into the barrel receptacle 27.

In particular, it may be provided that the ejection window 19 serves for receiving a cartridge chamber housing 20 of the barrel 7. As can be seen from FIG. 1, in the ready-to-use state of the firearm 1, the barrel 7 may be arranged in the slide 5 such that the cartridge chamber housing 20 is positioned in the region of the ejection window 19.

Figure 2:
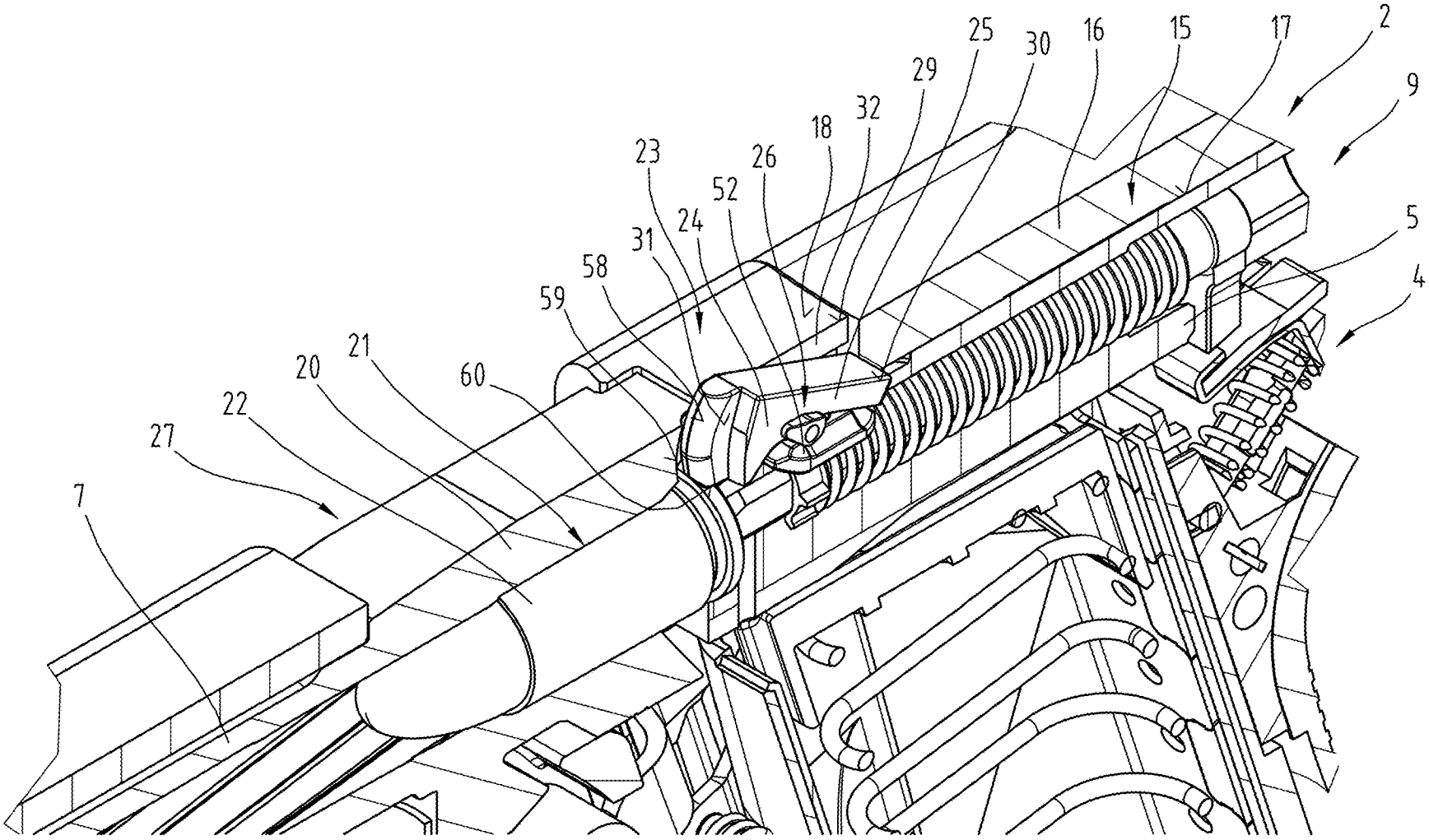
FIG. 2 a first longitudinal sectional representation of the first exemplary embodiment of the firearm.

As can be seen particularly well from FIG. 2, it may be provided that a cartridge chamber 21 is formed in the cartridge chamber housing 20. The cartridge chamber 21 may serve for receiving a cartridge 22. In particular, it may be provided that the cartridge chamber 21 is formed on the rear side 9 of the barrel 7.

As can also be seen from FIGS. 1 and 2, it may be provided that the slide assembly 2 comprises an indicator 23. The indicator 23 could serve for indicating whether a cartridge 22 may be in the cartridge chamber 21. In particular, it may be provided that the indicator 23 has a first lever arm 24. The first lever arm 24 may extend into the cartridge chamber 21 in the ready-to-operate state of the firearm 1. It may also be provided that the indicator 23 has a second lever arm 25. The second lever arm 25 may extend in the opposite direction from the first lever arm 24. It may also be provided that a pivot bearing 26 is formed between the first lever arm 24 and the second lever arm 25. The pivot bearing 26 may serve for pivotably receiving the indicator 23 on the slide 5.

In particular, it may be provided that an indicator receptacle 28, in which the indicator 23 is received, is formed in the slide 5. The indicator 23 may be pivotably received in the indicator receptacle 28. In particular, it may be provided that the indicator 23 is received in the slide 5 pivotably between a rest position 29 and an indicating position 30. In the representation according to FIGS. 1 and 2, the indicator 23 is in its indicating position 30. The indicator 23 may be forced into its indicating position 30 when there is a cartridge 22 in the cartridge chamber 21.

In particular, it may be provided that a recess 59, which leads into the cartridge chamber 21, is formed in the cartridge chamber housing 20. In particular, it may be provided that the recess 59 is formed on the rear side 9 of the barrel 7. The recess 59 may be formed in a way in which it complements the form and the function of the second lever arm 25.

In particular, it may be provided that, in the indicating position 30, an indicating area 31 of the indicator 23 may protrude from the slide surface 18 and may be consequently visible from the outside. In this case, the indicating area 31 may be arranged on the first lever arm 24. In this case, the indicating area 31 does not have to be a specially formed surface area, but may be formed by the uppermost area of the first lever arm 24. In particular, it may be provided that an indicator slit 32 is formed in the slide 5. The first lever arm 24 and the second lever arm 25 of the indicator 23 may be received in the indicator slit 32.

Figure 3A:
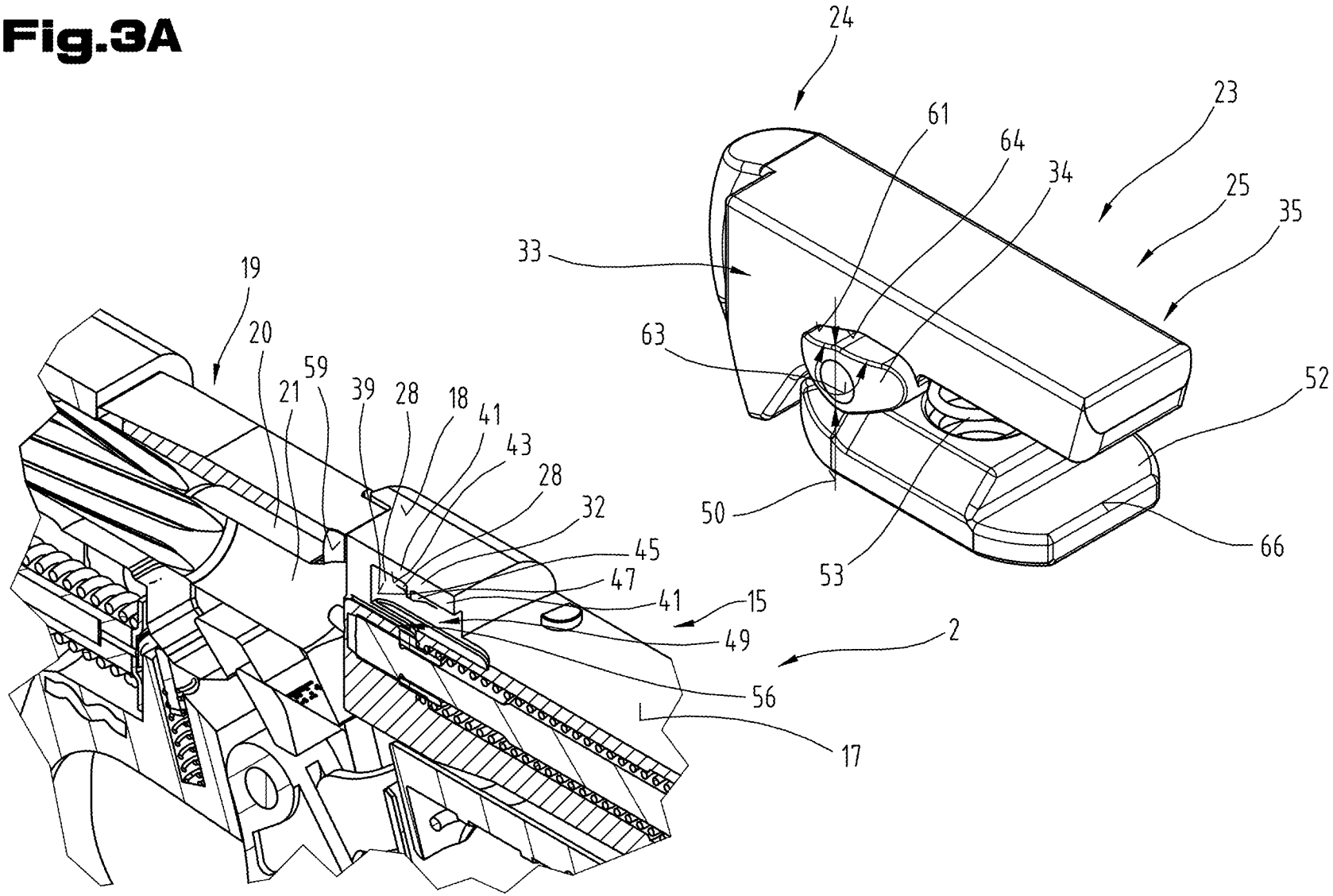
FIG. 3A a second longitudinal sectional representation of the first exemplary embodiment of the firearm with an indicator shown separately.

FIG. 3A shows the slide assembly 2 in a perspective longitudinal sectional representation. For the sake of clarity, in FIG. 3A the indicator 23 is shown in an exploded representation, removed from the indicator receptacle 28 and enlarged.

Figure 3B:
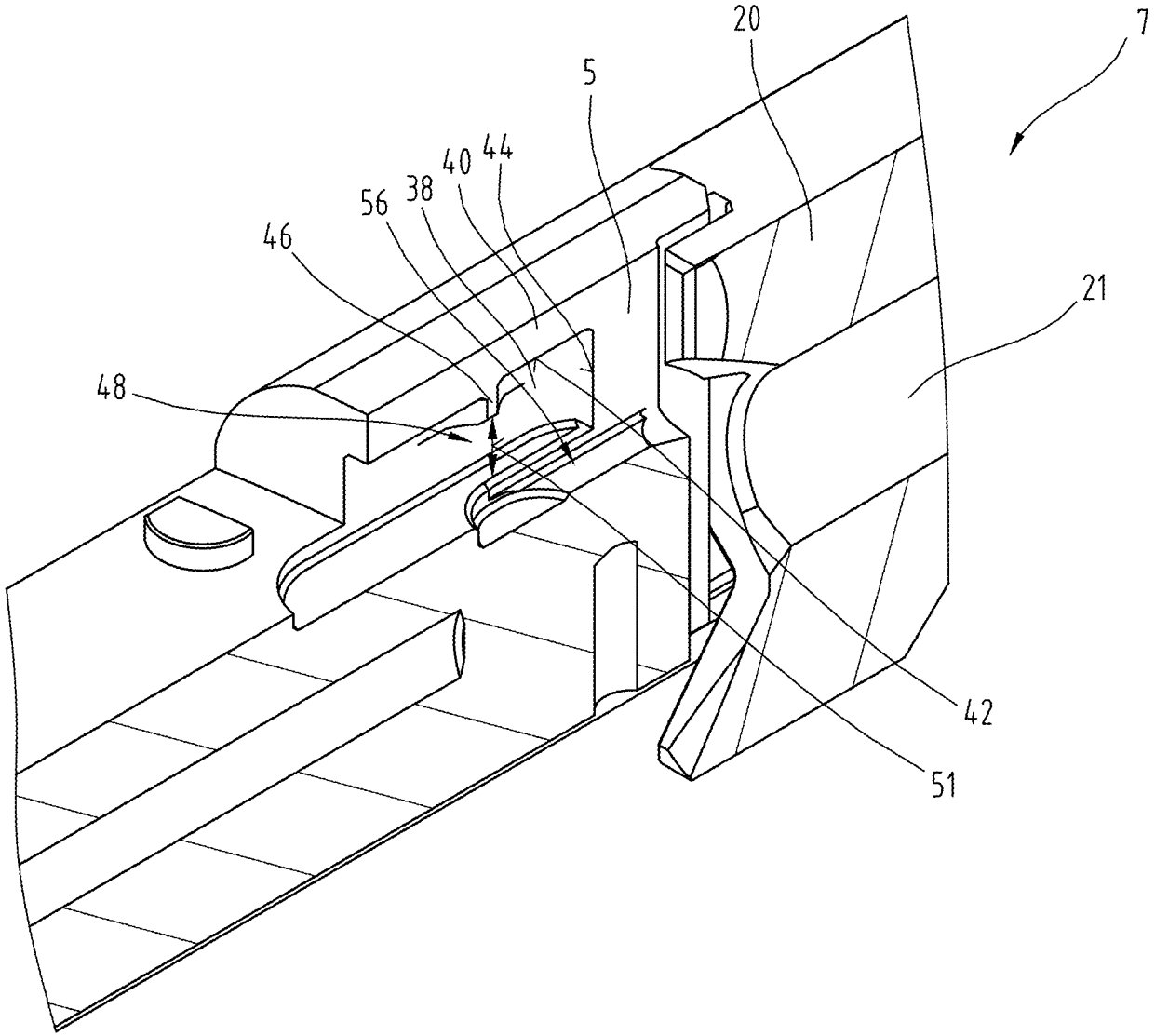
FIG. 3B a third longitudinal sectional representation of the first exemplary embodiment of the firearm with a not-depicted indicator.

FIG. 3B shows the slide assembly 2 in a second perspective longitudinal sectional representation. For the sake of clarity, in FIG. 3B the indicator 23 is not depicted at all.

Figure 4:
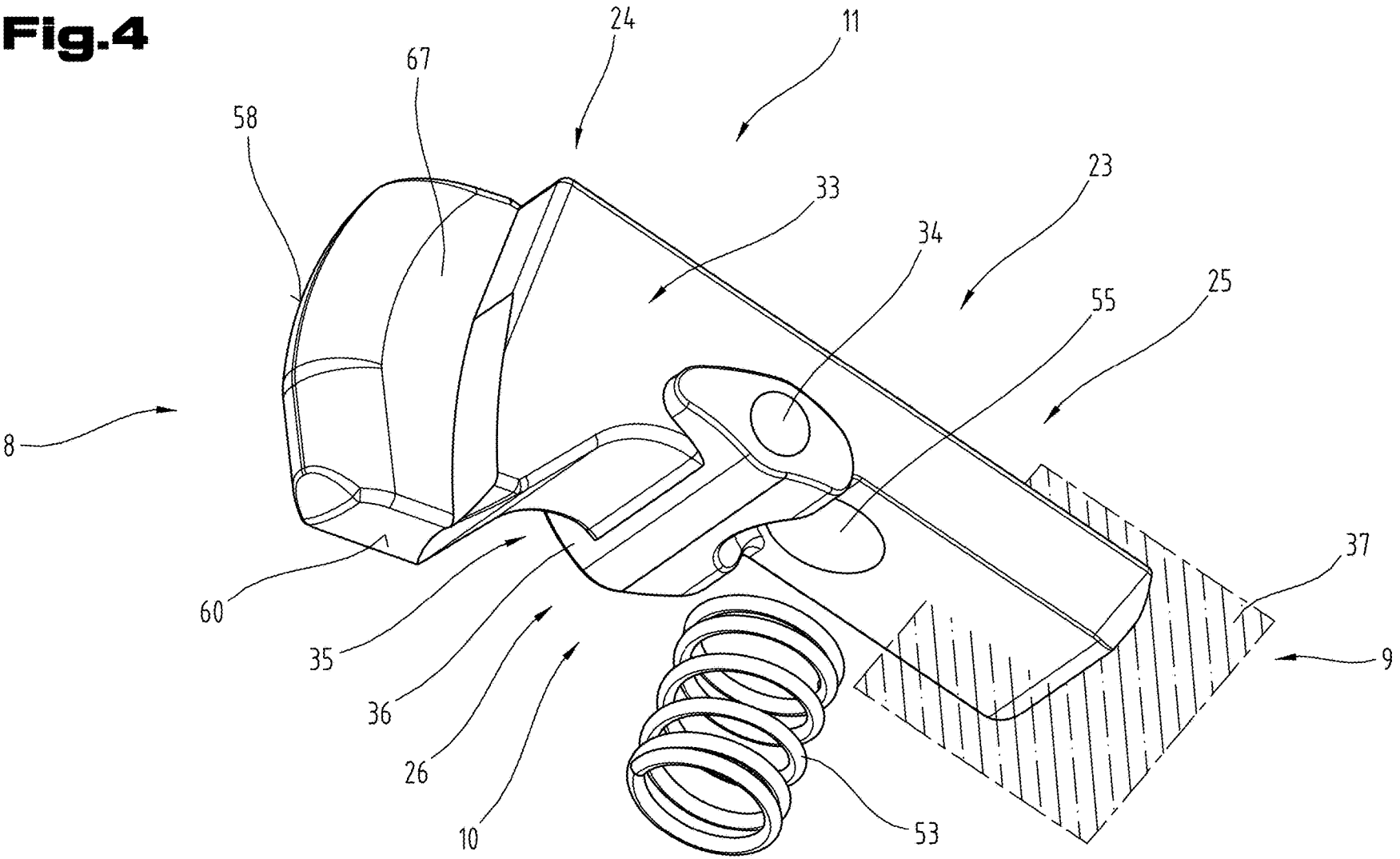
FIG. 4 a perspective view of a first exemplary embodiment of the indicator.

In FIG. 4, the indicator 23 is shown in a perspective view from obliquely below.

As can be seen particularly well from FIGS. 3A, 3B, and 4, it may be provided that the indicator 23 has a first pin 34 on a first side 33. It may also be provided that the indicator 23 has a second pin 36 on a second side 35. In particular, it may be provided that the first pin 34 and the second pin 36 form the pivot bearing 26. It may also be provided that the first pin 34 and the second pin 36 are formed as protruding laterally from the first lever arm 24 and the second lever arm 25. In particular, it may be provided that the first pin 34 and the second pin 36 are formed symmetrically with respect to an indicator symmetry plane 37. It may also be provided that the second lever arm 25 is also formed symmetrically with respect to the indicator symmetry plane 37. The first lever arm 24 may be formed unsymmetrically with respect to the indicator symmetry plane 37.

Figure 7:
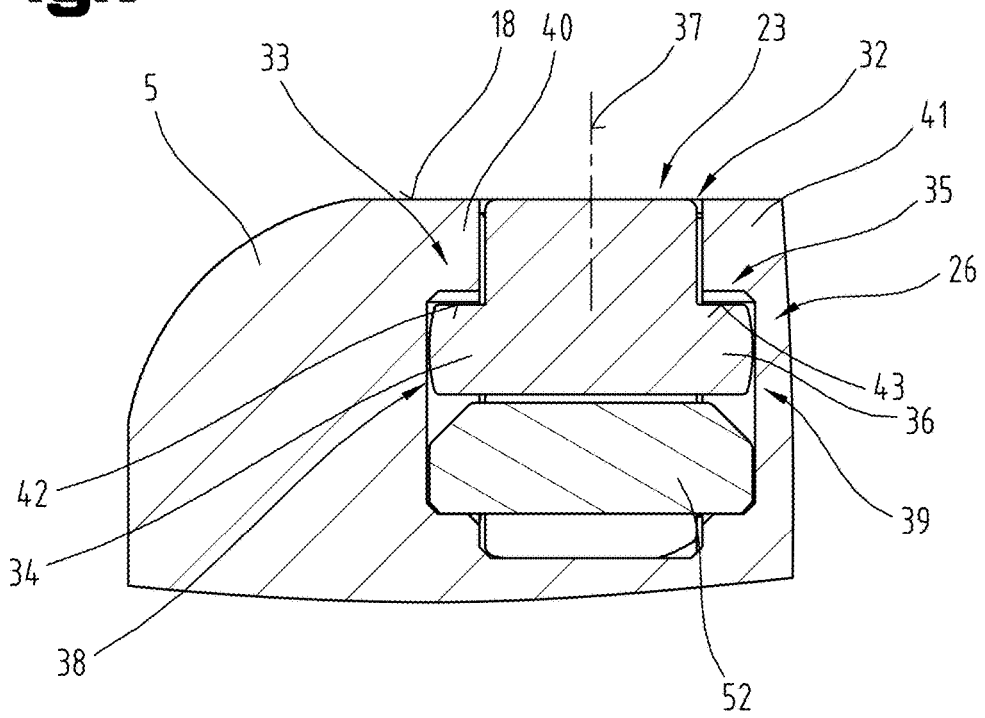
FIG. 7 a detailed view of a cross-sectional representation of the first exemplary embodiment of the firearm in the region of a first pin and a second pin.

As can be seen particularly well from FIG. 7, it may be provided that a first pin receptacle 38 and a second pin receptacle 39 are formed in the slide 5. The first pin receptacle 38 serves for receiving the first pin 34. The second pin receptacle 39 serves for receiving the second pin 36.

In particular, it may be provided that a first butting flank 40 is formed above the first pin receptacle 38. It may also be provided that a second butting flank 41 is formed above the second pin receptacle 39. The first butting flank 40 and the second butting flank 41 may adjoin the indicator slit 32.

In particular, it may be provided that a first butting area 42 is formed on the first butting flank 40 and a second butting area 43 is formed on the second butting flank 41. The first butting area 42 and the second butting area 43 may be formed at the same height.

It may also be provided that the first butting area 42 and the second butting area 43 are formed opposite the slide surface 18. In particular, it may be provided that the first butting area 42 and the second butting area 43 are arranged at a distance from the slide surface 18. In particular, it may be provided that the first pin 34 butts directly against the first butting area 42. It may also be provided that the second pin 36 butts directly against the second butting area 43.

In particular, it may be provided that the pins 34, 36 are pressed against the butting area 42, 43 from below. As can be seen from the cross section according to FIG. 7, the indicator 23 together with the pin receptacles 38, 39 and the indicator slit 32 may have a hammer head-like receptacle of a complementary form and function.

As can be seen particularly well from FIGS. 3A and 3B, a first front stop 44 and a second front stop 45 may be formed in the slide 5. The first front stop 44 and the second front stop 45 may serve for the displaceability of the indicator 23 in the longitudinal direction 12 towards the front side 8. In particular, it may be provided that the first pin 34 butts against the first front stop 44 and that the second pin 36 butts against the second front stop 45. In the longitudinal sectional representations according to FIGS. 3A) and 3B, only the second front stop 45 and the first front stop 44 are visibly shown in each case. In particular, it may be provided that the first front stop 44 and the second front stop 45 are arranged symmetrically in relation to the indicator slit 32.

It may also be provided that a first rear stop 46 and a second rear stop 47 are formed. The first rear stop 46 may extend downwards in a web-like manner from the first butting flank 40, in particular from the first butting area 42. The second rear stop 47 may extend downwards in a web-like manner from the second butting flank 41, in particular from the second butting area 43.

In particular, it may be provided that a first passage 48 is formed below the first rear stop 46.

It may also be provided that a second passage 49 is formed below the second rear stop 47. The first passage 48 and the second passage 49 may serve for threading the indicator 23, in particular the first pin 34 and the second pin 36, into the indicator receptacle 28.

In particular, it may be provided that the first pin 34 has a first pin height 50. It may also be provided that the first passage 48 has a first passage height 51. It may in this case be provided that the first passage height 51 is greater than the first pin height 50. This measure can achieve the effect that the first pin 34 can be easily displaced into its position through the first passage 48. In particular, it may be provided that the first passage height 51 is between 101% and 180%, preferably between 105% and 120% of the first pin height 50.

The second pin 36 and the second passage 49 may be mirror symmetrical to the first pin 34 and to the first passage 48, wherein the size ratios may be formed mutatis mutandis to the first pin 34 and to the first passage 48.

As can be seen particularly well from FIGS. 2 and 3A, it may be provided that a positioning element 52 is arranged under the indicator 23. The positioning element 52 is shown in FIGS. 5 and 6 in an enlarged representation in two different perspective views.

In particular, it may be provided that the positioning element 52 butts against the slide 5 or is received in it.

As can be seen from FIGS. 3A and 4, it may be provided that a positioning spring 53 is received between the positioning element 52 and the indicator 23. In particular, it may be provided that the positioning spring 53 is formed as a compression spring. The positioning spring 53 can support itself on the positioning element 52 and on the indicator 23 and exert pressure on these two elements.

Figure 5:
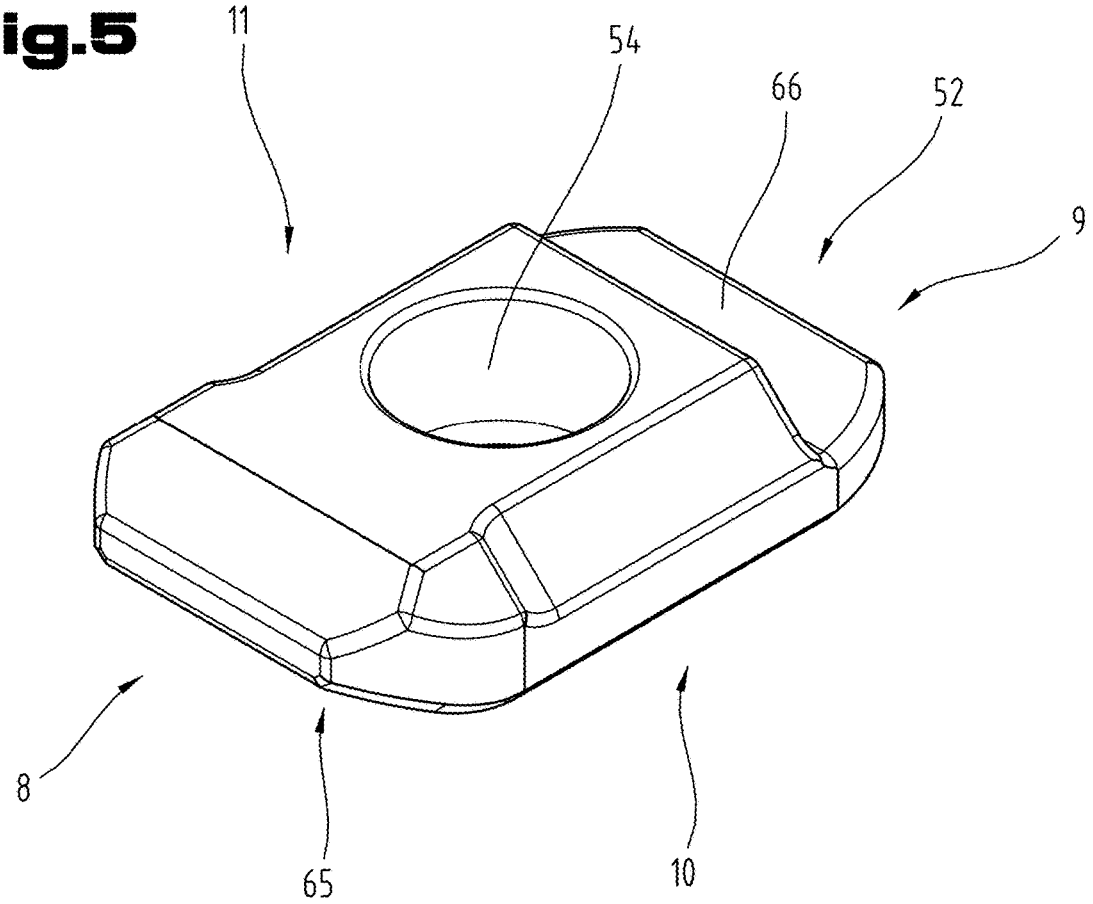
FIG. 5 a first perspective view of a first exemplary embodiment of a positioning element.
Figure 6:
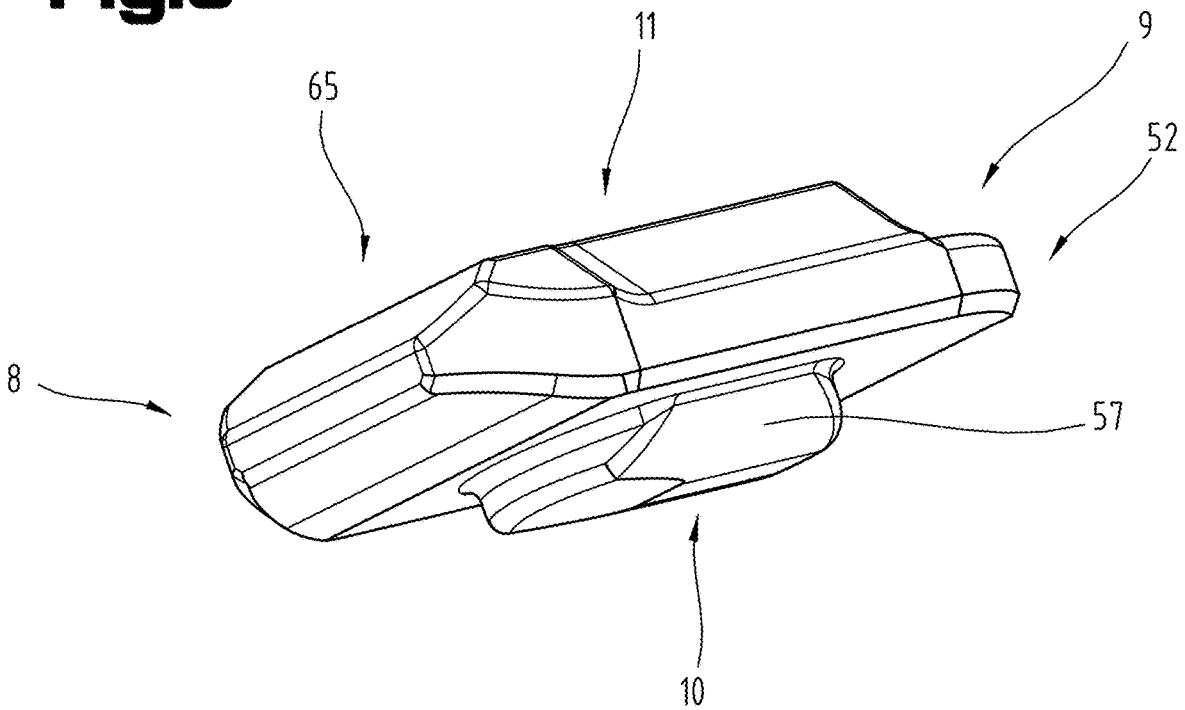
FIG. 6 a second perspective view of the first exemplary embodiment of the positioning element.

As can be seen particularly well from FIG. 5, it may be provided that a positioning spring receptacle 54 is formed in the positioning element 52. The positioning spring receptacle 54 may take the form of a cylindrical bore. It may also be provided that a positioning spring counterpart 55 is formed on the indicator 23. The positioning spring counterpart 55 may be arranged on the underside of the second lever arm 25. In particular, it may be provided that the positioning spring counterpart 55 takes the form of an elevation. Such an elevation may be a dome-like elevation. Furthermore, it is also conceivable that the positioning spring counterpart 55 takes the form of a pin. Furthermore, it is also possible that the positioning spring counterpart 55 takes the form of a depression. The positioning spring 53 may be positioned or guided by the positioning spring receptacle 54 and the positioning spring counterpart 55.

As can be seen particularly well from FIGS. 3A and 3B, it may be provided that a positioning element depression 56 is formed in the region of the indicator receptacle 28. As can be seen particularly well from FIG. 6, it may be provided that a positioning element base 57 is formed on the positioning element 52, received in the positioning element depression 56 in a way in which it complements its form and function.

As can be seen particularly well from FIG. 4, it may be provided that an end face 58 of the first lever arm 24 of the indicator 23 has a convex surface. In particular, it may be provided that a radius of curvature of the convex surface of the end face 58 corresponds to the distance from the two pins 34, 36. This measure can achieve the effect that, in the event of tilting of the indicator 23, the distance between the end face 58 and the corresponding recess 59 in the cartridge chamber housing 20 remains the same when the indicator 23 is tilted. In particular, it may in this case be provided of course that the recess 59 in the cartridge chamber housing 20 is formed in a way in which it complements the form and the function of the end face 58 of the second lever arm 25. This relationship between the recess 59 and the end face 58 can be seen particularly well in FIG. 2.

As can be seen particularly well from FIGS. 2 and 4, it may be provided that a cartridge butting area 60 is formed on the second lever arm 25. The cartridge butting area 60 may be formed on the underside of the second lever arm 25. In particular, it may be provided that the cartridge butting area 60 serves for butting against a cartridge 22 in the cartridge chamber 21.

As can be seen particularly well from FIG. 3A, it may be provided that the first pin 34 has a first pin area 61 and a second pin area 62 on its upper side. In particular, it may be provided that the first pin area 61 and the second pin area 62 are formed as flat surface areas. It may also be provided that the first pin area 61 and the second pin area 62 are arranged at an angle 63 to one another, as can also be clearly seen in FIG. 9B. The angle 63 may be an obtuse angle; in particular, it may be provided that the first pin area 61 and the second pin area 62 are arranged at an angle 63 between 110° and 179°, in particular between 140° and 170°, preferably between 150° and 160°, to one another. As can be seen from FIGS. 8A and 8B, the first pin area 61 and the second pin area 62 may serve as butting areas 42, 43, which serve for positioning the indicator 23.

It may also be provided that a transition radius 64 is formed between the first pin area 61 and the second pin area 62. The first pin area 61, the second pin area 62 and the transition radius 64 may serve for butting against the first butting area 42 of the first butting flank 40. The second pin 36 may be formed mutatis mutandis to the first pin 34.

As can be seen particularly well from FIGS. 5 and 6, it may be provided that the positioning element 52 is formed on the front side 8 as tapering in a tapering region 65. This has the advantage that this measure makes it easier to introduce the positioning element 52 into its position when assembling the slide assembly 2. In particular, it may be provided that the tapering region 65 is formed by chamfers. In particular, it may be provided that the tapering region 65 forms an end stop when mounting the positioning element 52, so that the positioning element 52 can be easily inserted into its position.

As can be seen particularly well from FIGS. 3A and 5, it may be provided that a cut-out 66 is formed in the positioning element 52. The cut-out 66 may be arranged on the rear side 9 of the positioning element 52. In particular, the cut-out 66 may be arranged at the top 11 of the positioning element 52. The cut-out 66 serves to ensure that the indicator 23, in particular the second lever arm 25, has sufficient freedom of movement when tilting the indicator 23. Furthermore, it may also be provided that, in the assembled state of the slide assembly 2, the attachment 16 protrudes into the cut-out 66, and consequently serves for fixing the positioning element 52.

As can be seen particularly well from FIG. 4, it may be provided that the first lever arm 25 has a clearance 67 on its front side 8. The clearance 67 can achieve the effect that it is not necessary for the complete width of the first lever arm 24 to protrude into the cartridge chamber 21, but only a reduced width of the first lever arm 24 to protrude into the cartridge chamber 21. This measure therefore allows intervention in the cartridge chamber 21 to be kept to a minimum. At the same time, it can be achieved by the clearance 67 that the first lever arm 24 has a sufficient width at its base to be able to have sufficient stability.

Figure 8A:
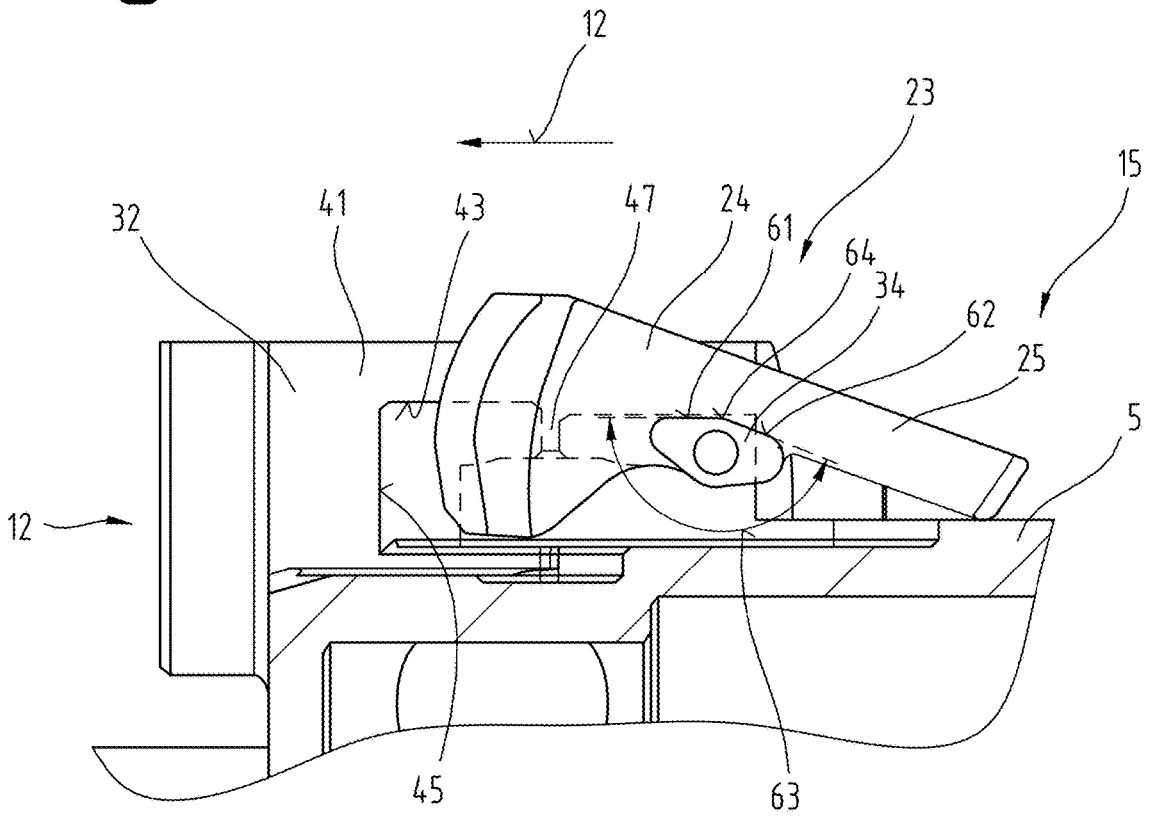
FIG. 8A a schematic sectional representation of a first method step for introducing an indicator into an indicator receptacle of a slide of the firearm.
Figure 8B:
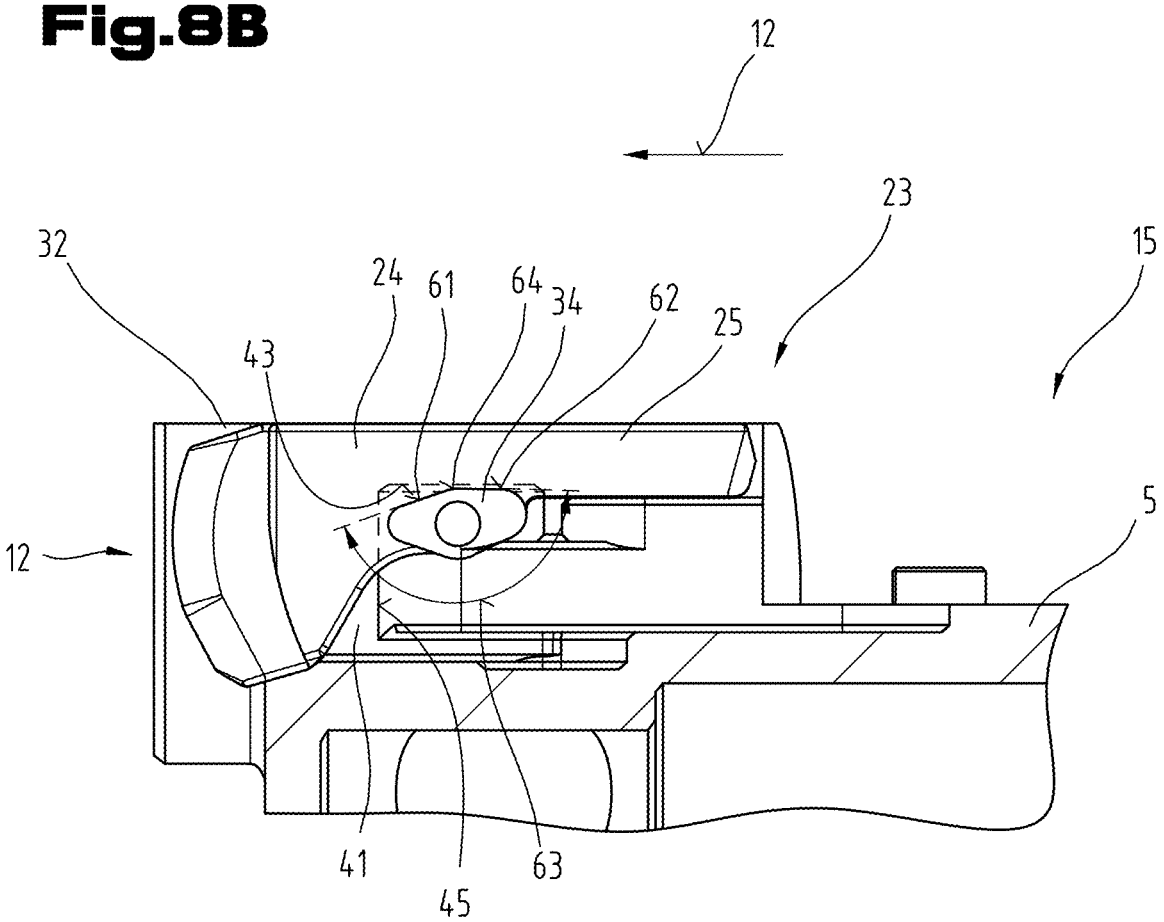
FIG. 8B a schematic sectional representation of a further method step for introducing an indicator into an indicator receptacle of a slide of the firearm.
Figure 8C:
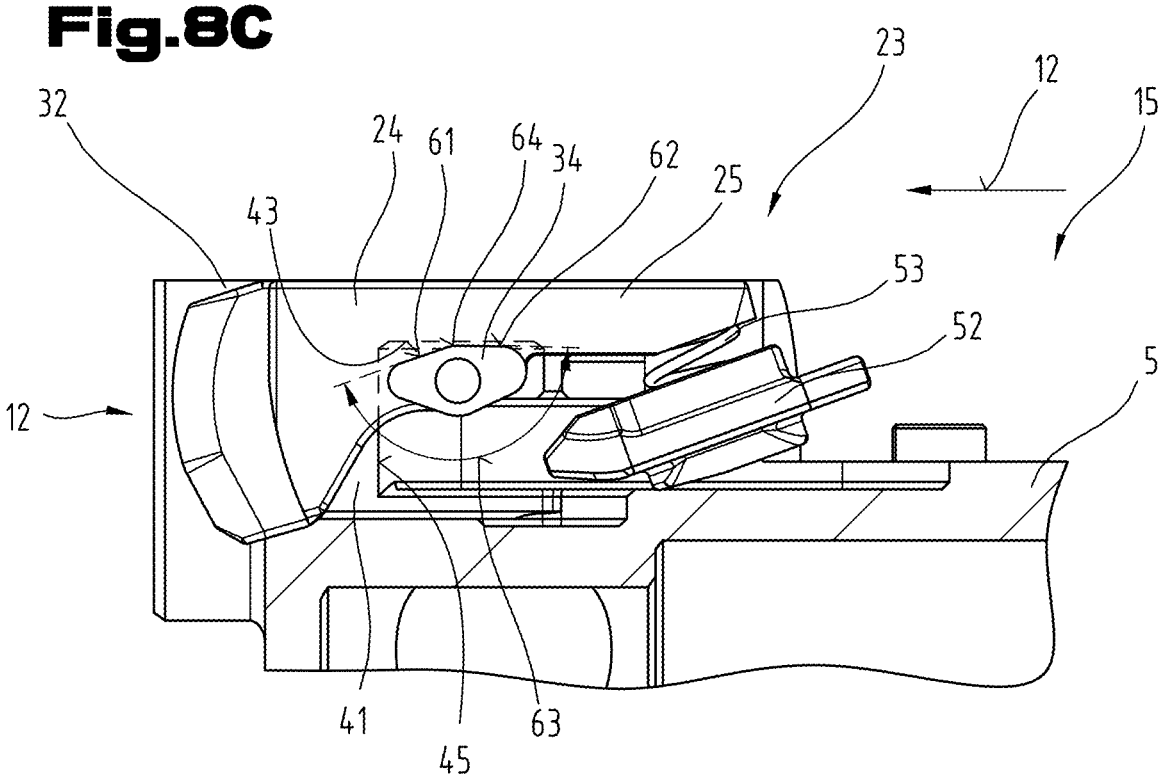
FIG. 8C a schematic sectional representation of a first method step for introducing the positioning element under the indicator.

With reference to FIG. 8A to 8C, the installation of the indicator 23 in the indicator receptacle 28 is now described.

In a first method step, the indicator 23 can be inserted into the depression 15 in the correct position in accordance with the representation according to FIG. 8A. The indicator 23 can then be displaced in the longitudinal direction 12 towards the front side 8, as indicated in FIG. 8A. The first lever arm 24 can thereby be displaced forwards in the indicator slit 32.

When inserting the indicator element 23, the first pin 34 can be displaced forwards through the first passage 48 under the first rear stop 46. Furthermore, the second pin 36 can be displaced forwards through the second passage 49 under the second rear stop 47.

The indicator 23 can thereby be displaced forwards until the first pin 34 butts against the first front stop 44 and the second pin 36 butts against the second front stop 45.

Subsequently, in accordance with the representation according to FIG. 8B, the second lever arm 25 of the indicator 23 can be raised so that the first pin 34 butts against the first butting area 42 and the second pin 36 butts against the second butting area 43. The indicator 23 is then in the indicator receptacle 28. Between the indicator 23 and the slide 5, a clearance is formed below the indicator 23.

In a subsequent method step according to FIG. 8C, the positioning element 52 together with the positioning spring 53 can then be displaced in the longitudinal direction 12 towards the front side 8 into this clearance and inserted into the positioning element depression 56. These joining steps can easily be carried out by hand without the aid of a tool.

Figure 9A:
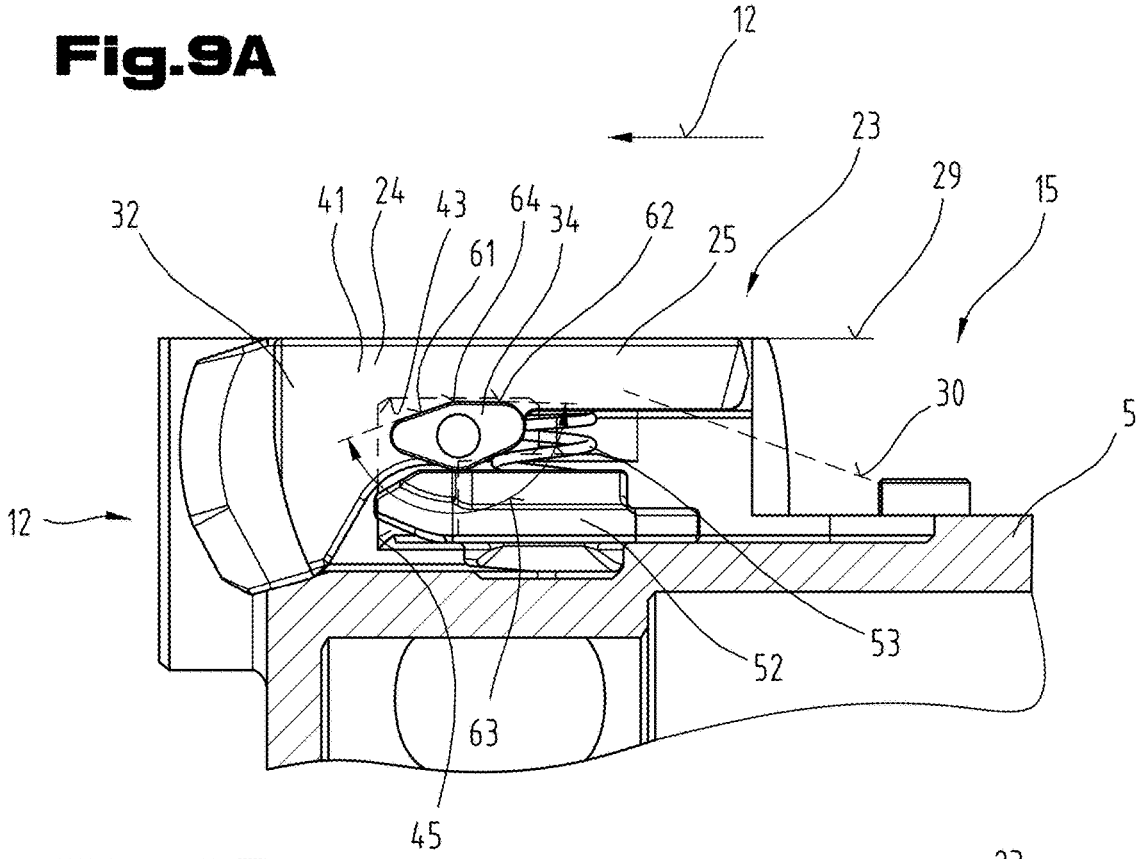
FIG. 9A a schematic sectional representation of an indicator in a rest position.

In the representation according to FIG. 9A, the indicator 23 is completely assembled in its rest position 29. The positioning spring 53 is in this case supported on the positioning element 52, and consequently pushes the second lever arm 25 of the indicator 23 upwards. The fact that the positioning spring counterpart 55, and consequently the positioning spring 53, is arranged behind the pivot bearing 26 means that the first lever arm 24 is pressed downwards. In the rest position 29, the second pin area 62 can butt against the first butting area 42.

In particular, it may be provided that the indicator 23 is held in its position by the first front stop 44 and the first rear stop 46 and by the second front stop 45 and the second rear stop 47. The first pin 34 may in this case be received between the first front stop 44 and the first rear stop 46. The second pin 36 may be received between the second front stop 45 and the second rear stop 47.

Figure 9B:
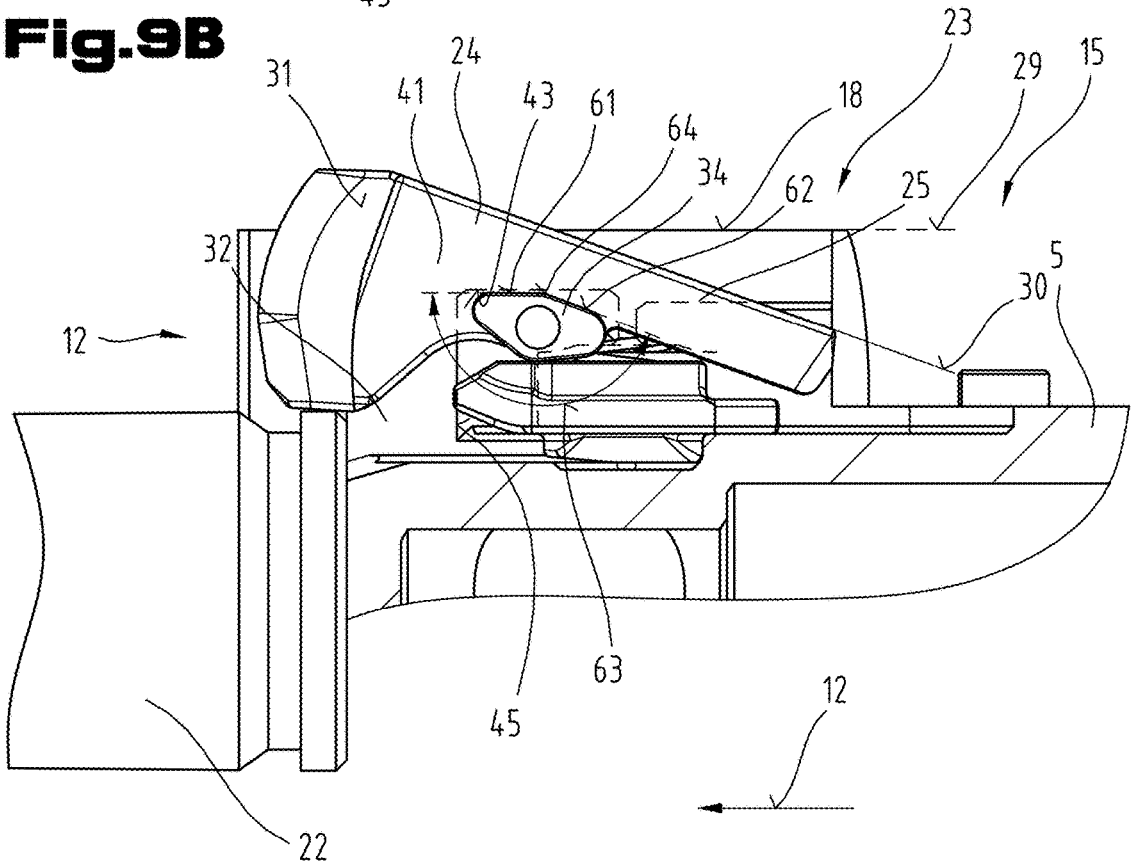
FIG. 9B a schematic sectional representation of an indicator in an indicating position.

When the cartridge 22 is then loaded into the cartridge chamber 21 in accordance with the representation according to FIG. 9B, the cartridge 22 may butt against the cartridge butting area 60 of the first lever arm 24 and press the first lever arm 24 upwards against the spring force of the positioning spring 53. The second lever arm 25 is in this case pivoted downwards and the positioning spring 53 is further compressed. In the pivoting operation, the first pin 34 thereby rolls on the first butting area 42 in such a way that, starting from the butting of the second pin area 62 via the transition radius 64, the first pin area 61 comes to butt against the first butting area 42.

As can be seen particularly well from FIG. 9B, the first lever arm 24 in this case protrudes from the slide surface 18, so that it could be apparent to the user that a cartridge 22 may be in the cartridge chamber 21. In particular, in this case the indicating area 31 of the first lever arm 24 is formed as protruding from the slide surface 18.

Figure 10:
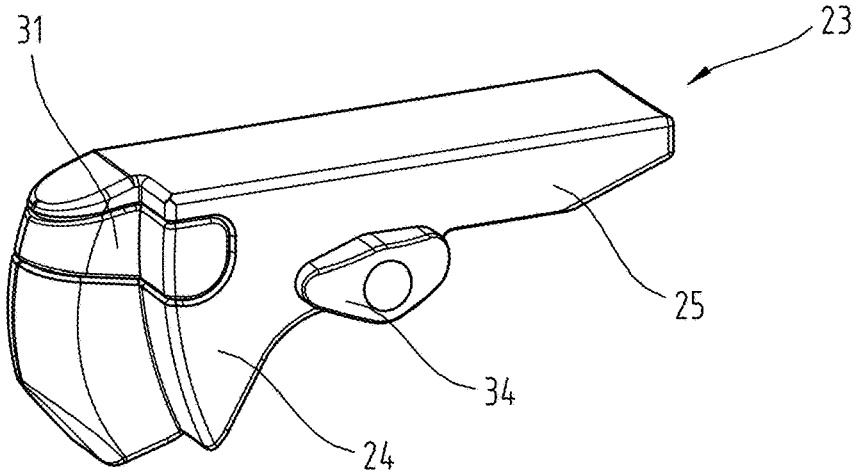
FIG. 10 a perspective view of a second exemplary embodiment of an indicator.
Figure 11:
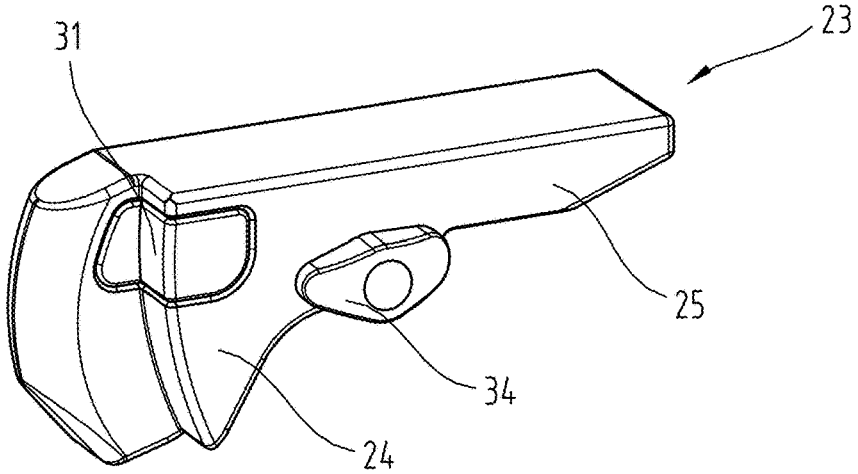
FIG. 11 a perspective view of a third exemplary embodiment of an indicator.
Figure 12:
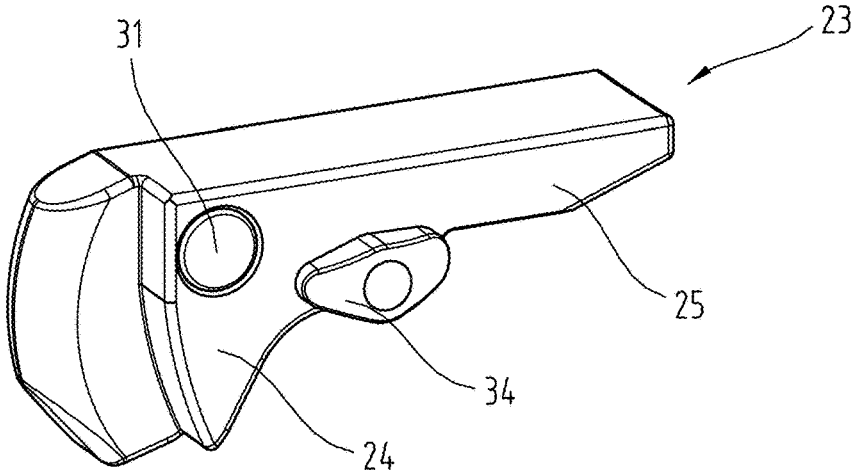
FIG. 12 a perspective view of a fourth exemplary embodiment of an indicator.

FIGS. 10, 11 and 12 each show a further embodiment of the indicator 23, which may be independent in itself, in a perspective view, with the same reference numerals or component designations as in the preceding FIG. 1 to 9B being used again for the same parts. In order to avoid unnecessary repetitions, reference is made to the detailed description in the preceding FIG. 1 to 9B.

In the exemplary embodiments of the indicator 23 of FIGS. 10, 11 and 12, the indicating area 31 is in each case formed on a separate component, which is inserted in the indicator 23, in particular in the first lever arm 24. This component may comprise or be formed of a dark glowing material. Such a material may be tritium, for example. Such a material may also be some other fluorescent material. Such a material may also be some other phosphorescent material. In the individual exemplary embodiments, the component has different shapes.

The exemplary embodiments show possible embodiment variants, it being noted at this stage that the invention is not restricted to the embodiment variants thereof specifically represented, but rather that various combinations of the individual embodiment variants with one another are also possible and, on the basis of the teaching for technical action provided by the present invention, this possibility of variation is within the ability of a person skilled in the art working in this technical field.

The scope of protection is determined by the claims. However, the description and the drawings should be used to interpret the claims. Individual features or combinations of features from the different exemplary embodiments shown and described can represent independent inventive solutions per se. The object on which the independent inventive solutions are based can be found in the description.

All of the indications of ranges of values in the present description should be understood as meaning that they include any and all subranges thereof; for example, the indication 1 to 10 should be understood as meaning that all of the subranges on the basis of the lower limit 1 and the upper limit 10 are included, i.e. all of the subranges begin with a lower limit of 1 or greater and end with an upper limit of 10 or less, for example 1 to 1.7, or 3.2 to 8.1, or 5.5 to 10.

For the sake of good order, it should finally be pointed out that, for better understanding of the construction, elements have sometimes been represented not to scale and/or enlarged and/or reduced in size.

LIST OF DESIGNATIONS

1 Firearm
2 Slide assembly
3 Frame assembly
4 Frame
5 Slide
6 Slide displacement direction
7 Barrel
8 Front side
9 Rear side
10 Underside
11 Upper side
12 Longitudinal direction
13 Transverse direction
14 Vertical direction
15 Depression
16 Attachment
17 Depression base area
18 Slide surface
19 Ejection window
20 Cartridge chamber housing
21 Cartridge chamber
22 Cartridge
23 Indicator
24 First lever arm
25 Second lever arm
26 Pivot bearing
27 Barrel receptacle
28 Indicator receptacle
29 Rest position
30 Indicating position
31 Indicating area
32 Indicator slit
33 First side
34 First pin
35 Second side
36 Second pin
37 Indicator plane of symmetry
38 First pin receptacle
39 Second pin receptacle
40 First butting flank
41 Second butting flank
42 First butting area

43 Second butting area
44 First front stop
45 Second front stop
46 First rear stop
47 Second rear stop
48 First passage
49 Second passage
50 First pin height
51 First passage height
52 Positioning element
53 Positioning spring
54 Positioning spring receptacle
55 Positioning spring counterpart
56 Positioning element depression
57 Positioning element base
58 End face
59 Recess
60 Cartridge butting area
61 First pin area
62 Second pin area
63 Angle
64 Transition radius
65 Tapering region
66 Cut-out
67 Clearance

The invention claimed is:

1. A slide assembly for a firearm, the slide assembly comprising:

a slide;

a barrel with a cartridge chamber;

an indicator for indicating whether a cartridge may be loaded in the cartridge chamber, wherein the indicator has a first lever arm and a second lever arm, wherein the first lever arm extends in a longitudinal direction into the cartridge chamber, wherein the first lever arm has a cartridge butting area for butting against a cartridge that may be received in the cartridge chamber and wherein the second lever arm is turned away from the cartridge chamber, wherein a pivot bearing for pivotably receiving the indicator in the slide is formed between the first lever arm and the second lever arm;

wherein a barrel receptacle for receiving the barrel is formed in the slide and wherein an indicator receptacle for receiving the indicator is formed in the slide;

wherein the pivot bearing has a first pinon a first side and has a second pinon a second side with respect to a transverse direction, and the indicator receptacle has a first pin receptacle and a second pin receptacle, wherein the first pin is received in the slide in the first pin receptacle and the second pin is received in the slide in the second pin receptacle.

2. The slide assembly according to claim 1, wherein the first pin and the second pin of the pivot bearing are formed as one part with the first lever arm and the second lever arm of the indicator.

3. The slide assembly according to claim 1, wherein the indicator receptacle comprises an indicator slit, which is arranged between the first pin receptacle and the second pin receptacle with respect to the transverse direction and extends to an upper side of the slide, wherein the first lever arm is received in the indicator slit and may be visible from the outside through the indicator slit, wherein a first butting flank is formed above the first pin receptacle and a second butting flank is formed above the second pin receptacle, wherein the first pin receptacle and the second pin receptacle are formed as a recess, which recesses laterally adjoin the indicator slit in the transverse direction and extend under the first butting flank and the second butting flank.

4. The slide assembly according to claim 3, wherein a depression is formed in the upper side of the slide behind the indicator receptacle, when seen in the longitudinal direction, in particular in that the depression serves for receiving an attachment, wherein the first pin receptacle and the second pin receptacle lead into the depression, wherein the indicator can be inserted into the indicator receptacle via the depression.

5. The slide assembly according to claim 3, wherein the indicator slit extends into the depression, when seen in the longitudinal direction.

6. The slide assembly according to claim 3, wherein an ejection window, which serves for receiving a cartridge chamber housing with the cartridge chamber of the barrel located in the cartridge chamber housing, is formed in the slide, wherein the indicator slit extends into the ejection window, when seen in the longitudinal direction.

7. The slide assembly according to claim 6, wherein a first front stop is formed between the first pin receptacle and the ejection window and in that a second front stop is formed between the second pin receptacle and the ejection window, wherein the first front stop and the second front stop serve for positioning the first pin and the second pin in the longitudinal direction.

8. The slide assembly according to claim 1, wherein a first rear stop is formed in the region of the first pin receptacle, wherein the first rear stop reaches downwards in a web-like manner from the first butting flank, and in that a second rear stop is formed in the region of the second pin receptacle, wherein the second rear stop reaches downwards in a web-like manner from the second butting flank, wherein a first passage is formed below the first rear stop and wherein a second passage is formed below the second rear stop;

wherein the first passage and the second passage are formed in such a way that the first pin and the second pin can be led through the first passage and the second passage in the longitudinal direction under the first rear stop and the second rear stop.

9. The slide assembly according to claim 1, wherein a positioning element, which is received in the indicator receptacle under the indicator, is formed, wherein a positioning spring is arranged in the positioning element, wherein the indicator is pushed upwards by means of the positioning spring.

10. The slide assembly according to claim 9, wherein a positioning element depression is formed in the indicator receptacle, wherein the positioning element depression is formed in a way in which it complements the form and the function of a positioning element base of the positioning element and serves for receiving the positioning element.

11. The slide assembly according to claim 1, wherein the first pin has a roof-shaped upper side with a first pin area and a second pin area, wherein the first pin area and the second pin area are arranged at an angle to one another, wherein a transition radius is formed between the first pin area and the second pin area.

12. The slide assembly according to claim 1, wherein an end face of the first lever arm has a convex curvature, when seen in a cross section.

13. An indicator for fitting in a slide assembly according to claim 1, the indicator comprising a first lever arm and a second lever arm, the first lever arm has a cartridge butting area for butting against a cartridge which may be received in the cartridge chamber, wherein a pivot bearing for pivotably receiving the indicator in the slide assembly is formed between the first lever arm and the second lever arm, characterized in that the pivot bearing has a first pinon a first side and has a second pinon a second side with respect to a transverse direction.

14. A firearm, comprising:

a frame assembly;

a slide assembly, wherein the slide assembly is received on the frame assembly;

wherein the slide assembly according to claim 1 is formed.

15. A method for assembling a slide assembly of a firearm, the method comprising:

providing a slide;

providing a barrel with a cartridge chamber;

providing an indicator for indicating whether a cartridge may be loaded in the cartridge chamber, wherein the indicator has a first lever arm and a second lever arm, wherein the first lever arm has a cartridge butting area for butting against a cartridge which may be received in the cartridge chamber and wherein a pivot bearing for pivotably receiving the indicator in the slide is formed between the first lever arm and the second lever arm;

wherein a barrel receptacle for receiving the barrel is formed in the slide and wherein an indicator receptacle for receiving the indicator is formed in the slide, wherein the pivot bearing has a first pinon a first side and has a second pinon a second side with respect to a transverse direction, and the indicator receptacle has a first pin receptacle and a second pin receptacle;

inserting the indicator into the indicator receptacle so that the first lever arm extends in a longitudinal direction into the cartridge chamber and the second lever arm is turned away from the cartridge chamber and the first pin is received in the slide in the first pin receptacle and the second pin is received in the slide in the second pin receptacle.

* * * * *